US008191978B2

(12) United States Patent
Bansyo et al.

(10) Patent No.: US 8,191,978 B2
(45) Date of Patent: Jun. 5, 2012

(54) INKJET IMAGE FORMER

(75) Inventors: Toshihiro Bansyo, Ibaraki-ken (JP); Hitoshi Arai, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 181 days.

(21) Appl. No.: 12/796,767

(22) Filed: Jun. 9, 2010

(65) Prior Publication Data

US 2010/0315451 A1 Dec. 16, 2010

(30) Foreign Application Priority Data

Jun. 10, 2009 (JP) ..... P2009-139005

(51) Int. Cl.
*B41J 29/38* (2006.01)

(52) U.S. Cl. ..... 347/6

(58) Field of Classification Search ..... 347/5, 6, 347/17, 19, 101, 102
See application file for complete search history.

(56) References Cited

U.S. PATENT DOCUMENTS 5,614,933 A * 3/1997 Hindman et al. ..... 347/103
6,132,021 A * 10/2000 Smith et al. ..... 347/6

FOREIGN PATENT DOCUMENTS

JP 2007296754 A 11/2007

* cited by examiner

*Primary Examiner* — An Do
(74) *Attorney, Agent, or Firm* — The Nath Law Group; Jerald L. Meyer; Robert T. Burns

(57) ABSTRACT

A controller works with a measure of temperature of ink at a temperature sensor within a first temperature range to have an inkjet head propel out droplets of ink at a first discharge speed for formation of images, and with a measure of temperature of ink at the temperature sensor within a second temperature range lower than the first temperature range to have the inkjet head propel out droplets of ink at a second discharge speed greater than the first discharge speed for formation of images, and the controller determines that end regions of a frame of images to be formed in regions at transfer-longitudinal ends of a sheet to be transferred in a sheet transfer system have a print ratio within a prescribed range, to execute formation of images.

7 Claims, 11 Drawing Sheets

INKJET IMAGE FORMER

BACKGROUND OF INVENTION

1. Field of the Invention

The present invention relates to an inkjet image former, and in particular, to an inkjet image former allowing for a printing start time to be set earlier at low temperatures with controlled affects of mist production.

2. Description of Relevant Art

There is a widely used inkjet printer including a print head for propelling out droplets of ink to form images on a print sheet. In the inkjet printer, the print head has a discharge mechanism composed of a set of piezoelectric elements or the like to be driven with applied drive voltages to propel out ink droplets. For use in the inkjet printer, typically available ink tends to have an increased viscosity under a low temperature environment, as a property that constitutes a difficulty in use of a normal drive voltage to keep adequate discharge quantities of ink. To this point, at low temperatures, there is use of a heater for heating ink, waiting for an adequate ink temperature to start a printing. As a result, the start time of printing is delayed under a low temperature environment, as an issue. This issue is significant, in particular at an ink circulation type printer that has an ink circulation route with much ink to be heated.

Besides the delay in start time of printing due to an increased ink viscosity under a low temperature environment, the inkjet printer undergoes, along with discharge of ink, production of mist being undesirable miniature droplets of ink that may adhere inside a printer housing, degrading a print quality, as an issue, as described in Japanese Patent Application Laid-Open 2007-296754.

SUMMARY OF INVENTION

To have an early start time of printing under a low temperature environment, there may be a setting introduced to make larger respective drive voltages being applied to the ink discharge mechanism, affording to keep adequate ink discharge quantities. However, any increase in drive voltage might cause an increase in discharge speed of ink accompanied by an increase in production rate of ink mist. The increase in production rate of ink mist might cause an increased quantity of mist adhering inside the printer housing accompanied by a degraded print quality due to flying mist and accumulated mist in the housing getting print sheets dirty, as an issue.

It therefore is an object of the present invention to provide an inkjet image former allowing for a printing start time to be set earlier at low temperatures with controlled affects of mist production.

To achieve the object described, according to an aspect of the present invention, there is an image former comprising an ink route configured for circulation of ink, a sheet transfer system configured for transfer of sheets, an inkjet head configured to use ink received from the ink route to form images on a sheet in the sheet transfer system, a temperature measuring element configured to measure a temperature of ink received from the ink route, and a controller configured for control of temperatures of ink in the ink route and control of actions of the sheet transfer system and the inkjet head, the controller being adapted to work with a measure of temperature of ink at the temperature measuring element within a first temperature range, to implement a first control process of having the inkjet head propel out droplets of ink at a first discharge speed for formation of images, and with a measure of temperature of ink at the temperature measuring element within a second temperature range lower than the first temperature range, to implement a second control process of having the inkjet head propel out droplets of ink at a second discharge speed greater than the first discharge speed for formation of images, wherein the controller is adapted to determine that end regions of a frame of images to be formed in regions at transfer-longitudinal ends of a sheet to be transferred in the sheet transfer system have a print ratio within a prescribed range, to execute formation of images.

DESCRIPTION OF EMBODIMENTS

Figure 1:
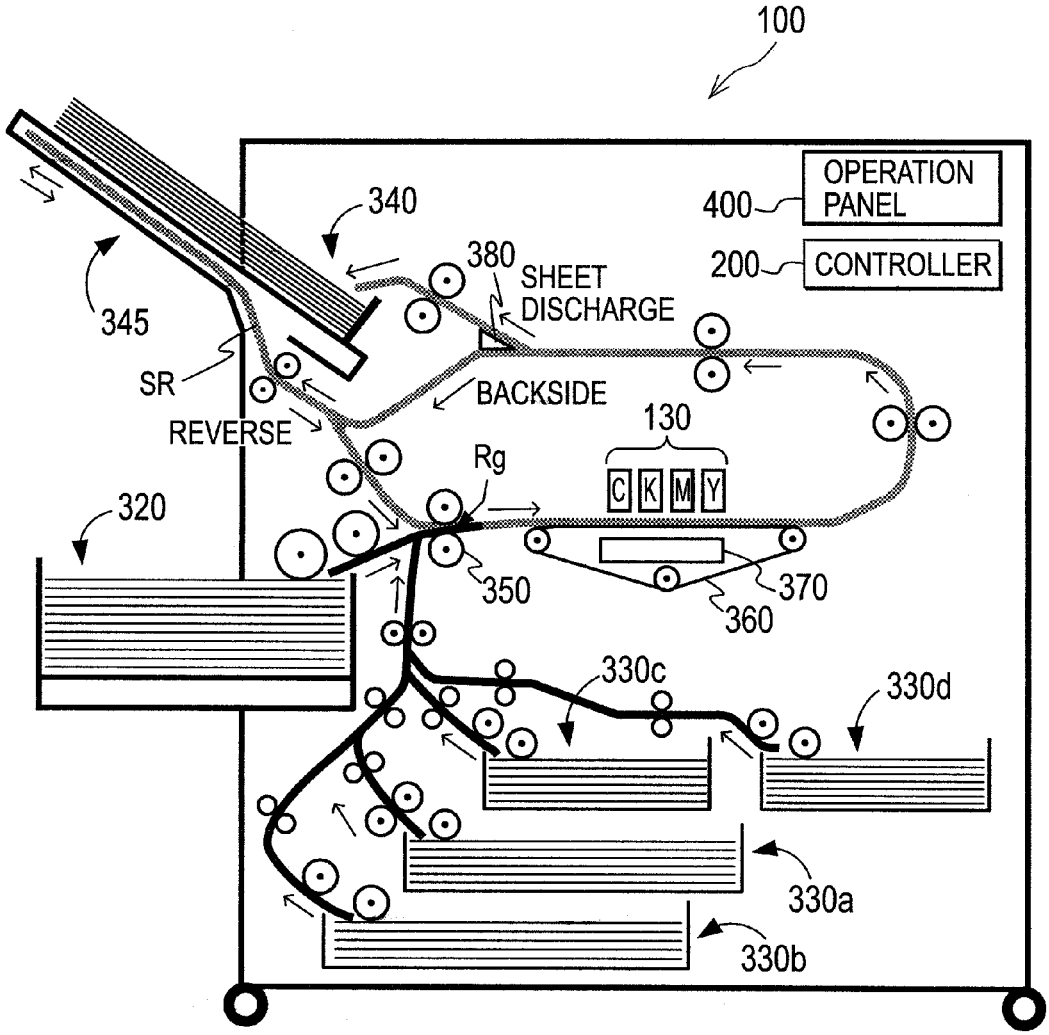
FIG. 1 is a schematic diagram of an inkjet printer according to an embodiment of the present invention.

There will be described the embodiments of the present invention with reference to the drawings. FIG. 1 is a schematic diagram illustrating an inkjet printer 100 with a sheet transfer system according to an embodiment of the invention. As illustrated by FIG. 1, in the inkjet printer 100, the sheet transfer system includes a sheet feed system configured for feeds of print sheets. The sheet feed system includes a set of internal feeders, a side feeder, and a re-feeder. Internal feeders have their feed trays 330 (330*a*, 330*b*, 330*c*, 330*d*) each installed in a printer housing. The side feeder has a side feeding stacker 320 exposed outside at a sidewall of the printer housing. The re-feeder is connected to a switchback route SR. The sheet transfer system further includes a sheet discharge system that has a discharge port 340 configured to discharge printed sheets.

The inkjet printer 100 is a line color printer of an inkjet system. The line color printer of inkjet system has a printing mechanism configured with a plurality of inkjet heads 130 each extending in a transverse direction perpendicular to the sheet transfer direction. Each inkjet head is formed with a multiplicity of nozzles for propelling out droplets of pure black or color ink to form images by lines.

The inkjet printer 100 has, among other functional components (not depicted), a controller 200 configured with a control board including a CPU, a frame processor, memories, and the like, and an operation panel 400 configured as an input interface to display menus and accept user's operations.

Print sheets are fed one by one from any feeder that has a corresponding one of feed trays 330 or the side feeding stacker 320, along a feed route of the feeder (represented by bold lines in the figure) provided with drives such as rollers, to a register Rg. The register Rg is configured with a pair of register rollers 350, to serve for a positioning at a leading edge of a print sheet, with a correction to avoid oblique travel inclusive. Any fed sheet is put to a pause at the register Rg, waiting a prescribed timing to travel toward the printing mechanism.

At a transfer-directional end past the register Rg, there is an array of inkjet heads 130. In this embodiment, there are four inkjet heads arrayed to be a C (cyan), a K (black), an M (magenta), and a Y (yellow) in an ascending order with respect to the distance from the register Rg. The print sheet to be printed is transferred by an endless transfer belt 360 facing the inkjet heads 130, at a preset speed according to a printing condition, to have images formed thereon by lines with droplets of ink propelled from the inkjet heads 130. There is a suction fan 370 installed inside the transfer belt 360. The transfer belt 360 has a multiplicity of air communication holes formed therethrough. The print sheet being transferred is sucked onto an upside of the transfer belt 360 by suction forces produced by rotation of the suction fan 370.

Past a printing, the print sheet is further transferred along a transfer route in the printer housing, by drives thereon such as rollers. The printing may be complete simply at one side of the print sheet. For such the single-side printing, the print sheet is transferred as it is guided to the discharge port 340. Then, it is discharged onto a sheet stacker 345 provided as a sheet receiver at the discharge port 340, to stack thereon with the printed side down. The sheet stacker 345 is protruded from the printer housing, in a tray form with a required certain thickness. The sheet stacker 345 has an inclined surface cooperating with an end wall at a lower end of the surface, so that any print sheet discharged on the surface or on a previous stacked sheet or sheets thereon is caused to slide down along the inclination, and trimmed at the end wall in due course, to stack up as necessary.

There may be a print sheet to be printed on both sides thereof, i.e., on both a front side (as one side thereof to be first printed) and a backside (as the other side to be printed next). For such the double-side printing, the print sheet past a printing on the front side is not guided to the discharge port 340, but still transferred inside the printer housing. To this end, the inkjet printer 100 has a route selector 380 operable for route changeover to select a transfer route for backside printing. As this transfer route is selected at the route selector 380, the print sheet is pulled into the switchback route SR, where it is reversed upside down and switched back to transfer along a re-feed route. The print sheet is moved along this route by drives thereon such as rollers, to re-feed to the register Rg, where its backside is printed in a similar manner to the front-side printing. Thereafter, the double-side printed print sheet is transferred to the discharge port 340.

In the inkjet printer 100, the sheet stacker 345 has therein a space employed for switchback operations in the double-side printing. The space in the sheet stacker 345 is enclosed to avoid external removal of a print sheet in switchback phase. This can prevent the print sheet in switchback phase from being inadvertently pulled out by user. For the inkjet printer 100, the sheet stacker 345 is an inherent accessories, so making use of a space in the sheet stacker 345 for switchback eliminates the need of provision of an additional space for switchback. It thus prevents the printer housing from being enlarged in size. Further, eliminated common use of a discharge port as a switchback route enables switchback operations to be done in parallel with discharge operations of other print sheets.

Figure 2:
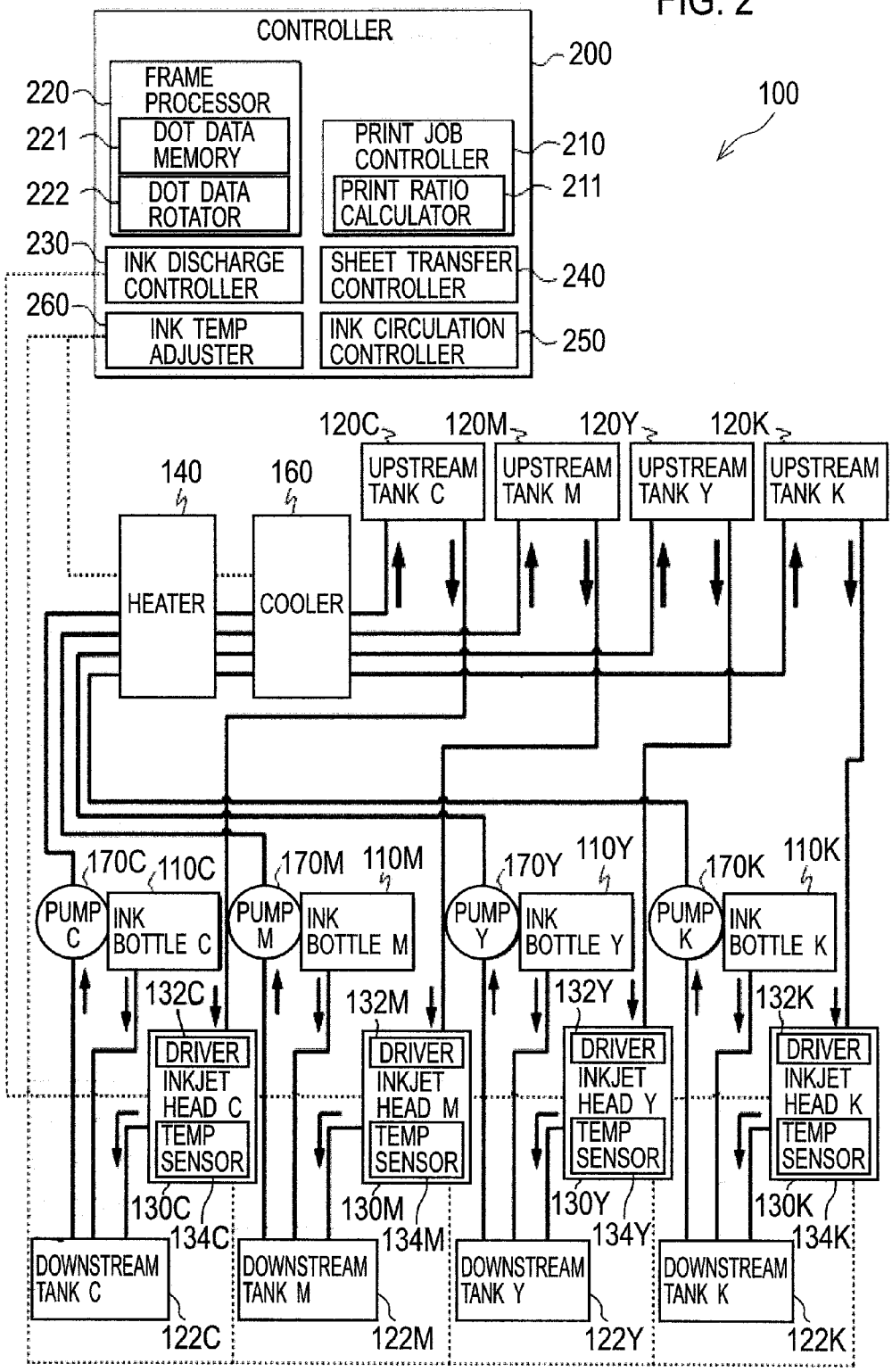
FIG. 2 is an explanatory diagram of configurations of a system of ink circulation routes and a controller of the inkjet printer of FIG. 1.

FIG. 2 is an explanatory diagram of configurations of a system of ink circulation routes and the controller 200 of the inkjet printer 100. As shown in the figure, the inkjet printer 100 is configured as a color printer using four colors of ink being CMYK. Those colors of ink are supplied from four replaceable inkbottles: an inkbottle 110C supplying cyan ink; an inkbottle 110M supplying magenta ink; an inkbottle 110Y supplying yellow ink; and an inkbottle 110K supplying black ink. For discussions irrespective of ink colors, those inkbottles will each be collectively referred to as an inkbottle 110. Also for other associated elements, they will be likewise referred to.

Supplied ink from each inkbottle 110 flows through an ink path such as a resin or metallic tube, to a downstream tank 122 installed downstream of an inkjet head 130. The inkjet printer 100 has four downstream tanks 122 being a downstream tank 122C configured as a reservoir of cyan ink, a downstream tank 122M configured as a reservoir of magenta ink, a downstream tank 122Y configured as a reservoir of yellow ink, and a downstream tank 122K configured as a reservoir of black ink.

Accumulated ink in the downstream tank 122 is sent by a pump 170 to an upstream tank 120 installed upstream of the inkjet head 130. The inkjet printer 100 has four pumps 170 being a pump 170C, a pump 170M, a pump 170Y, and a pump 170K, and four upstream tanks 120 being an upstream tank 120C, an upstream tank 120M, an upstream tank 120Y, and an upstream tank 120K. Ink is thus sent to the upstream tank 120 and therefrom to the inkjet head 130, where it is propelled in the form droplets through multiple nozzles to form images.

The inkjet printer 100 has four inkjet heads 130 being an inkjet head 130C configured to discharge cyan ink, an inkjet head 130M configured to discharge magenta ink, an inkjet head 130Y configured to discharge yellow ink, and an inkjet head 130K configured to discharge black ink. This embodiment employs an array of inkjet heads of a type using piezoelectric elements for propelling out ink droplets. There may be employed an arbitrary applicable type of inkjet head. For instance, there may be employed an array of inkjet heads of a type using heat generating elements for heating ink to produce air bubbles, thereby propelling out ink droplets.

Each inkjet head 130 is provided with a driver 132 (132C, 132M, 132Y, 132K) configured to receive a set of ink discharge data sent from the controller 200 and output a set of drive signals for driving piezoelectric elements in accordance therewith. The inkjet printer 100 is configured as a circulation system for circulation of ink, in which flux of ink unused for formation of images at each inkjet head 130 is returned to an associated downstream tank 122. There is a water head difference between the downstream tank 122 and an associated upstream tank 120, used to have ink flow from the upstream tank 120 through the inkjet head 130 to the downstream tank 122.

There is a print quality of ink assured within a specified ink temperature range, so flux of ink in ink paths, which may have lowered wall temperatures depending on an ambient temperature for instance, should be heated at ink temperatures lower than the quality-assuring temperature range. To this point, the ink circulation routes have a heater 140 installed thereon for heating ink in their ink paths from outside. On the other hand, there is dissipation of heat along actions of piezoelectric elements and operation of drivers 132, besides generation of Joule's heat due to vibrations in ink. Such heat and occasional high ambient temperatures may cause ink temperatures of ink routes to rise, exceeding the quality-assuring temperature range. To prevent such situations, the ink circulation routes have a cooler 160 installed thereon for cooling ink in their ink paths from outside. In each ink circulation route, pumped ink is sent through ink paths in the heater 140 and the cooler 160 to the upstream tank 120.

Each inkjet head 130 is provided with a temperature sensor 134 (134C, 134M, 134Y, 134K) adapted for direct or indirect measurement of an associated ink temperature.

The controller 200 is configured to serve as a set of functional elements for controlling actions in various control processes in the inkjet printer 100, with processes for print job and ink temperature control inclusive. In this embodiment, the controller 200 includes a print job controller 210, a frame processor 220, an ink discharge controller 230, a sheet transfer controller 240, an ink circulation controller 250, and an ink temperature adjuster 260.

The print job controller 210 is configured to govern control actions such as those for execution, interruption, restart, error coping, and log recording of received print jobs. Print jobs received may include a printing process according to a set of print data transmitted from a computer, a copying process according to a set of image data read by an image scanner, and a facsimile printing process according to a set of image data transmitted through a telephone line.

The print job controller 210 is adapted to work in a low ink-temperature range to execute a printing of a print job meeting a prescribed criterion, as will be described later. This is for the sake of coping with a low temperature phase to make a print start time earlier. The criterion may be set up, for instance, in the form of a permissible range of values of a print ratio to dots in prescribed regions at transfer-directional ends of print sheet or print sheets, as it is equal to or smaller than a reference value being a threshold upper end. This enables controlling adverse affects of ink mist on print sheets. To this end, the print job controller 210 includes a print ratio calculator 211. The print job controller 210 is adapted to work in the low ink-temperature range to accept an interfaced user's selection to or not to execute an early start mode that affords to start a printing earlier than a normal mode.

The print ratio calculator 211 is configured to calculate a print ratio in regions at both ends in a transfer direction, i.e. transfer (axis)-longitudinal direction, of print sheet in accordance with an associated set of dot data. Also, it is configured to calculate a print ratio of dot data to be printed in regions at both ends in a perpendicular direction to the transfer direction, i.e. transfer (axis)-transverse direction of print sheet. The print ratio may be a ratio of a number of printed dots to a total number of dots in prescribed regions, for instance.

The frame processor 220 is configured to perform an image processing of a frame of image data to be printed for a print job. The image processing to be performed at the frame processor 220 may include a print data expansion process, and an image data color conversion process, binarization process, and halftone process. The image processing provides a set of processed data formatted in an array of (blocks or cells of) dot data, which is stored in a dot data memory (or area) 221 that may be a formatted sub-area in a storage area of a memory. The frame processor 220 has a dot data rotater 222 configured to work as necessary to implement a process of rotating any array of dot data at 90 degrees to provide a transposed array of dot data, re-storing this in the dot data memory 221. For the rotation of dot data, the dot data rotater 222 is driven under a later-described condition.

The ink discharge controller 230 is configured to calculate an ink discharge rate or quantity for each dot in accordance with an array of image-processed dot data of a respective ink color stored in the dot data memory 221. Then, the ink discharge controller 230 outputs to the driver 132 at each inkjet head 130 a print command composed of a set of control data each including an image data (cf. FIG. 3) representative of a quantity of ink to be discharged at an associated one of pixels (i.e., dots) of images in an image frame for a corresponding color of ink. At each inkjet head 130, each dot printed on a sheet has a tone defined by a number of droplets of ink put thereon, so dots in highlight image regions are defined by relatively small numbers of ink droplets, and dots in shadow image regions are defined by relatively large numbers of ink droplets.

The sheet transfer controller 240 is configured to control actions for transfer or feed of print sheets at associated sheet feeders, register rollers 350, transfer belt 360, and other transfer mechanisms. The ink circulation controller 250 is configured for control of actions such as those of pumps 170 to circulate ink in each ink circulation route. The ink temperature adjuster 26 is configured to control the heater 140 or cooler 160 in accordance with measures at temperature sensors 134 in the inkjets heads 130, working to serve for each color of ink to regulate or adjust the ink temperature within a quality-assuring temperature range.

Figure 3:
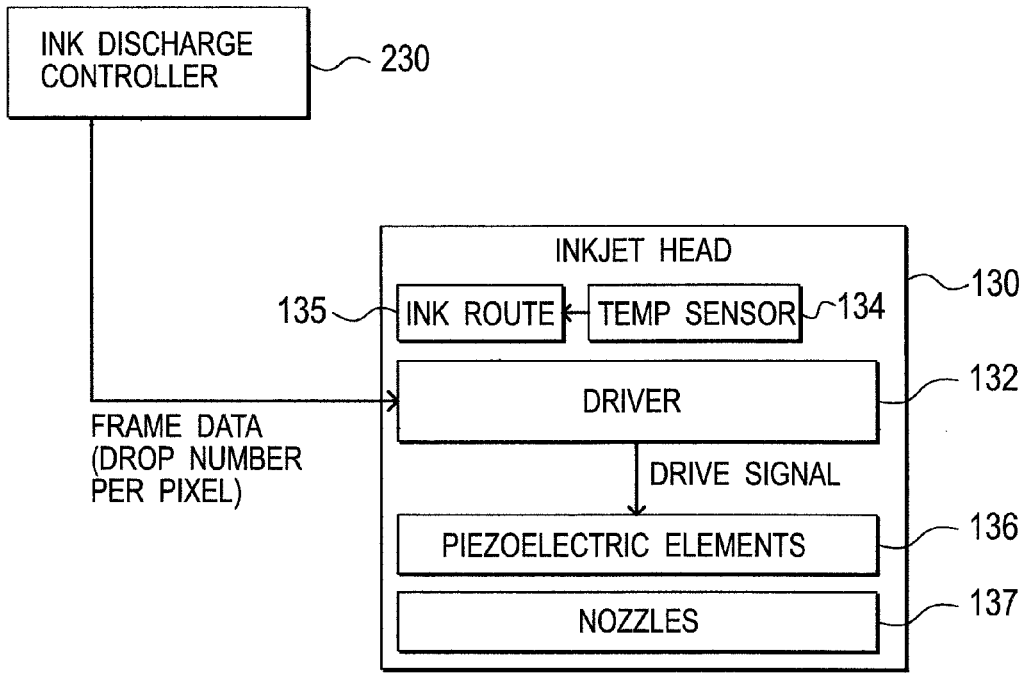
FIG. 3 is a functional block diagram of an inkjet head of the inkjet printer of FIG. 1.

FIG. 3 shows in block diagram a configuration of an inkjet head 130 that is an arbitrary one of four inkjet heads (130C, 130M, 130Y, 130K). As illustrated in the figure, the inkjet head 130 is configured to receive ink from an ink path 135 constituting part of an ink circulation route, to discharge ink for a printing. The inkjet head 130 has a temperature sensor 134 adapted to measure an ink temperature of ink the inkjet head 130 is receiving from the ink path 135, as it is representative of an ink temperature of ink flowing in the ink path 135.

There is a print command (cf. FIG. 2) output from the ink discharge controller 230 and input to a driver 132 at the inkjet head 130, in the form of a set of control data each including an image data indicating per pixel a corresponding number of ink droplets of a commensurate volume. The driver 132 is configured to work in accordance with a set of control data input thereto to generate a set of drive signals each composed of a corresponding number of drive pulses of prescribed commensurate voltages, to output to an array of piezoelectric elements 136. Then, given a drive signal, each driven piezoelectric element 136 is commensurately deformed a corresponding number of times, each time propelling out a commensurate volume of ink droplet through an associated nozzle in an array of discharge nozzles 137. It may thus be seen to construe each combination of piezoelectric element 136 and discharge nozzle 137 working as an ink discharge element, and each driver 132 working as a drive signal output interface operable at low ink temperatures, to output a set of drive signals with greater voltages than at normal temperatures, to an array of piezoelectric elements 136.

Description is now made of a processing to execute a printing according to this embodiment. According to the embodiment there is a first reference temperature set as a lower limit of a suitable ink temperature range being a quality-assuring ink temperature range. The first reference temperature is assumed to be 25° C., for instance. Therefore, the ink temperature adjuster 260 is to work at ink temperatures lower than 25° C., to operate the heater 140 for heating ink, while the ink circulation controller 250 is then operated for circulation of ink.

Therefore, if the execution of printing is kept interrupted until the ink temperature comes up to 25° C. or higher, the start of printing would have to be delayed at low ink temperatures. In particular, in this embodiment, there would be an increased tendency to provide an extra heating time for the inkjet printer 100 of an ink circulation type that has much quantities of ink to be heated.

To this point, according to the embodiment, there is a second reference temperature to be set after an interfaced user's intention, to permit execution of a printing meeting a prescribed criterion subject to an ink temperature equal to or higher than the second reference temperature. The second reference temperature should be lower than the first reference temperature, and is assumed to be 20° C., for instance. However, at temperatures lower than the first reference temperature, there appears a tendency for the viscosity of ink to increase, with a resultant failure to maintain discharge rates or quantities of ink within an adequate range. As a countermeasure thereto, there is a setting introduced for making the voltages of drive signals being output to the array of piezoelectric elements 136 greater than at normal temperatures, to keep ink discharge rates or quantities within an adequate range. For such the setting, increased voltages may be determined, for instance, by using a database on temperature vs. voltage characteristic curves prepared by experiments or the like.

The reason why resides in that because of the tendencies to come with temperature dependent variations in viscosity of ink, for ink discharge quantities to decrease as the ink temperature falls or increase as the ink temperature rises, it is necessary to set the discharge quantities to optimal values by adjusting their drive voltages in dependence on a measure of ink temperature at the temperature sensor 134 installed in each inkjet head 130.

However, at each piezoelectric element 136, simple increase in drive voltage might cause an increase in discharge speed of ink accompanied by an increase in production rate of ink mist. The increase in production rate of ink mist might cause an increased quantity of mist adhering inside the printer housing accompanied by a degraded print quality due to flying mist and accumulated mist in the housing getting print sheets dirty, as an issue. To avoid such situations, according to the embodiment, there is provision of a criterion or criteria to be met to execute a printing to thereby control adverse affects of mist production, as will be discussed later about an example of embodiment. For simplicity the discussion will not cover ink temperatures raised beyond a quality-assuring temperature range.

Figure 4:
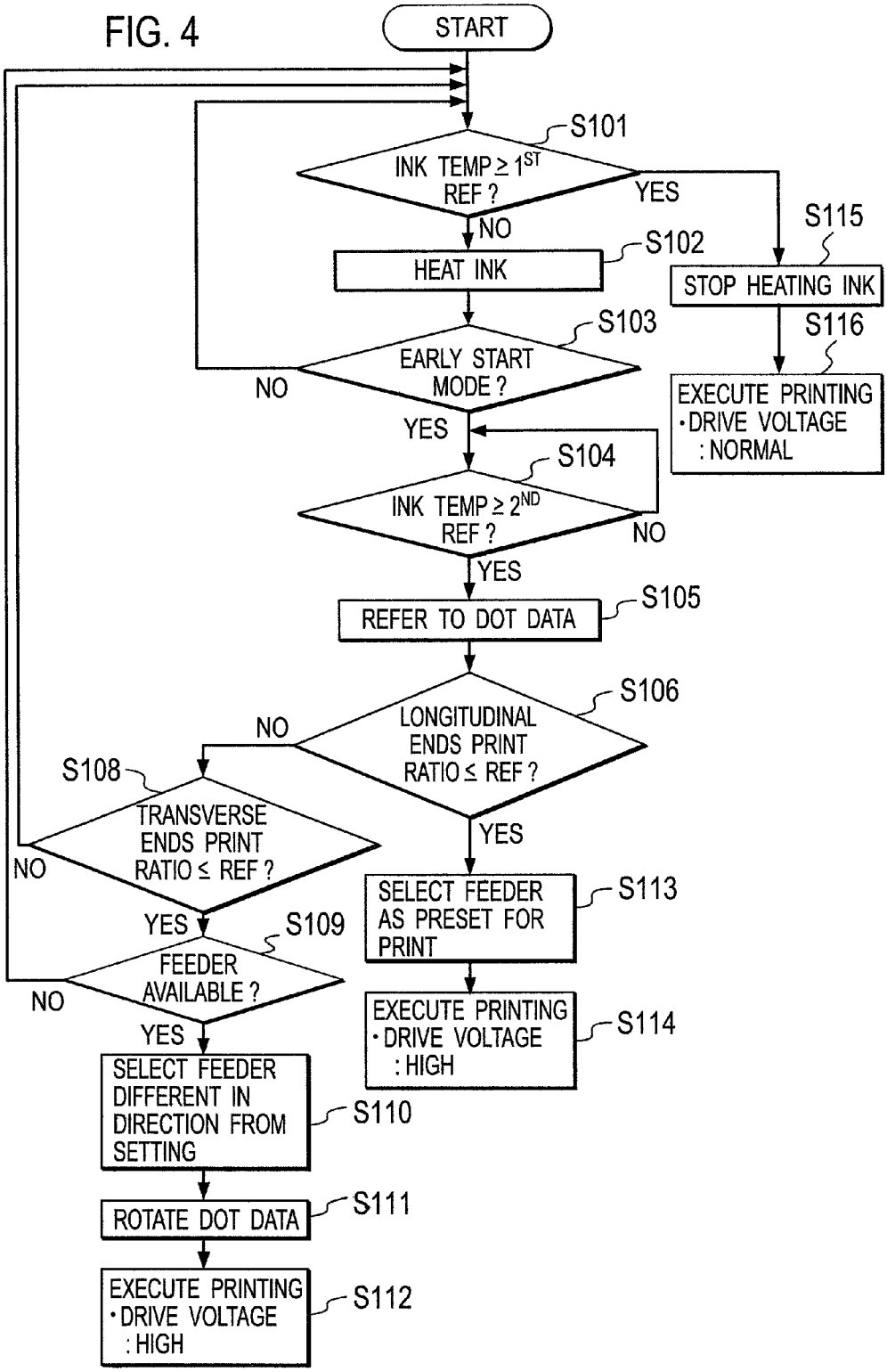
FIG. 4 is a flowchart of control actions in a processing for execution of print in the inkjet printer of FIG. 1.

FIG. 4 is a flowchart of control actions in a processing for execution of print according to the embodiment. In this embodiment, for control of a printing to be executed at low ambient temperatures, focused is a print ratio in regions at both ends in a transfer direction of a sheet or sheets. It is noted that the processing described below starts after reception of an interfaced user's instruction for execution of print. The instruction for execution of print is accompanied by user's designation for orientation of print sheets to be longitudinal or transverse in an associated print setting.

First, at a step S101, it is determined whether or not the temperature sensor 134 has a current measure of ink temperature within a quality-assuring range of temperatures equal to or higher than a first reference temperature that is set to 25° C. for instance. If the measure falls within the range (Yes at the step S101), it should be a quality-assuring temperature, and the control flow goes to a step S116 for a normal printing, via a step S115 to stop a heating of ink being made. For measures of temperatures different among colors of ink, there may be use of a lowest ink temperature or an average among ink temperatures for instance, as a base to make a decision thereon. In a normal printing process, each driver 132 is adapted to supply an associated set of piezoelectric elements 136 with a set of drive signals of normal voltages each assuring an adequate discharge quantity within the quality-assuring temperature range.

On the other hand, if the measure of ink temperature is lower than the first reference temperature, or lower than 25° C. for instance (No at the step S101) then the control flow goes to a step S102 for operation of the ink temperature adjuster 260 to drive the heater 140 for heating ink to raise the ink temperature up to an adequate temperature. Then, it comes to a step S103.

At the step S103, it is determined whether or not an early start mode is selected by an interfaced user's instruction to make a start of printing earlier at low ink temperatures. Unless the early start mode is selected (No at the step S103), the control flow again goes to the step S101, to wait for a measure of ink temperature equal to or higher than the first reference temperature, without starting print.

For situations attended by a desire to make an early start of printing at low ink temperatures, there may be for instance a setting at a certain printer driver for providing a print instruction to make an early start of printing, a setting through the operation panel 400 of the inkjet printer 100 to make an early start of printing, or a setting by a manager of the inkjet printer 100 to provide a default key area displayed for operation to determine an early start of printing to be made or not.

If the early start mode is selected to make an early start of printing at low ink temperatures (Yes at the step S103) then the control flow goes to a step S104 to determine whether or not the temperature sensor 134 has a current measure of ink temperature within a range of temperatures equal to or higher than a second reference temperature that is set to 20° C. for instance. If the measure is lower than the second reference temperature (No at the step S104), the control flow again goes to the step S104 to wait for a measure of ink temperature equal to or higher than the second reference temperature. This is because of the tendency of ink to have a significant increased viscosity at temperatures lower than the second reference temperature, resulting in failure to keep adequate ink discharge quantities, even with a re-setting to increase voltages of drive signals. In this regard, the second reference temperature is set as an accumulation point of ink temperatures at which drive signals are unable to keep adequate ink discharge quantities even with increased voltages.

If the measure of ink temperature is equal to or higher than the second reference temperature (Yes at the step S104), the control flow goes to a step S105 to refer to a set of dot data to be printed in a print job as a current target of the process. The set of dot data is stored in the dot data memory 221 after deployment at the frame processor 220.

Then, at a step S106, it is determined after calculation of a print ratio in regions at both ends in a transfer direction of print sheet, whether or not the print ratio is equal to or smaller than a prescribed reference value. If the print ratio in regions at both transfer-longitudinal ends of print sheet falls within a range of values equal to or smaller than the reference value (Yes at the step S106), the control flow goes to a step S113 to provide a setting for a feed of sheet by a feeder configured to feed a print sheet set in a sheet orientation designated in the print setting, and to a step S114 to execute a printing process in accordance with a set of dot data stored in the dot data memory 221. In this situation, for adequate ink discharge quantities to be secured, each driver 132 is adapted to supply an associated set of piezoelectric elements 136 with a set of drive signals with higher voltages than the normal process. That is, those drive signals have increased voltages for execution of a printing to print relatively small numbers of dots in regions at transfer-longitudinal ends of a print sheet or print sheets.

Figure 5A:
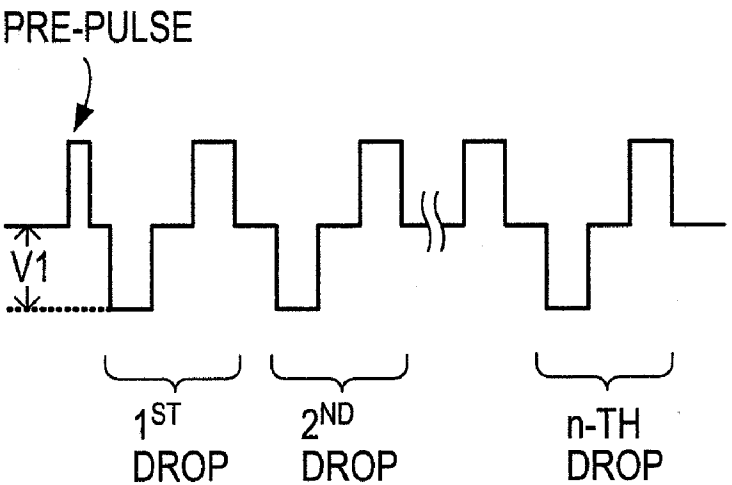
FIGS. 5A and 5B are diagrams of exemplary drive signals with different voltages.
Figure 5B:
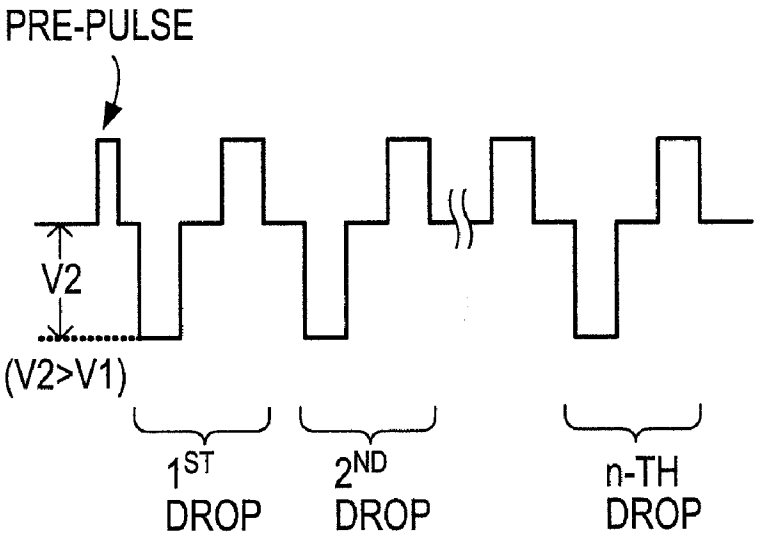

FIGS. 5A and 5B are diagrams of exemplary drive signals output to piezoelectric elements 136, FIG. 5A illustrating a drive signals output at a normal ink temperature, FIG. 5B illustrating a drive signals output at a lower ink temperature. The drive signals are each applied to a piezoelectric element, as a sequence of a controlled number of pulse sets each consisting of a negative pulse with a controlled negative voltage V1 or V2 (V1<V2) for swelling an ink chamber, and a positive pulse with a preset positive voltage for contracting the ink chamber. Each pulse set drives the piezoelectric element to propel out an ink droplet of a size commensurate with the magnitude of negative voltage V1 or V2. Each drive signal acts as a pulse set sequence to drive the piezoelectric element to propel out, onto a pixel, a number of ink droplets corresponding to the number of pulse sets. Each drive signal has a pre-pulse put as a short pulse before a beginning pulse set to propel out a stable size of ink droplet.

In this embodiment, there is a set of drive signals each applied to a corresponding element in an associated set of piezoelectric elements 136, in the form of a sequence of pulse sets each having a negative voltage of a magnitude V1, as illustrated in FIG. 5A, for a normal phase of environment defined by a measure of ink temperature equal to or higher than the first reference temperature, or in the form of a sequence of pulse sets each having a negative voltage of a magnitude V2 greater than the magnitude V1, as illustrated in FIG. 5B, for a low temperature phase of environment defined by a measure of ink temperature lower than the first reference temperature and equal to or higher than the second reference temperature. The negative voltage of magnitude V1 may well be changed depending on the measure of ink temperature.

Accordingly, even at low ink temperatures, adequate ink discharge quantities are secured, while increased drive voltages are accompanied by increased mist production rates due to increased ink discharge speeds. In this regard, the present example of embodiment is adapted to execute a printing for print jobs having reduced amounts of print in regions at both ends in a transfer direction of print sheets, to thereby control affects of mist production.

Figure 6:
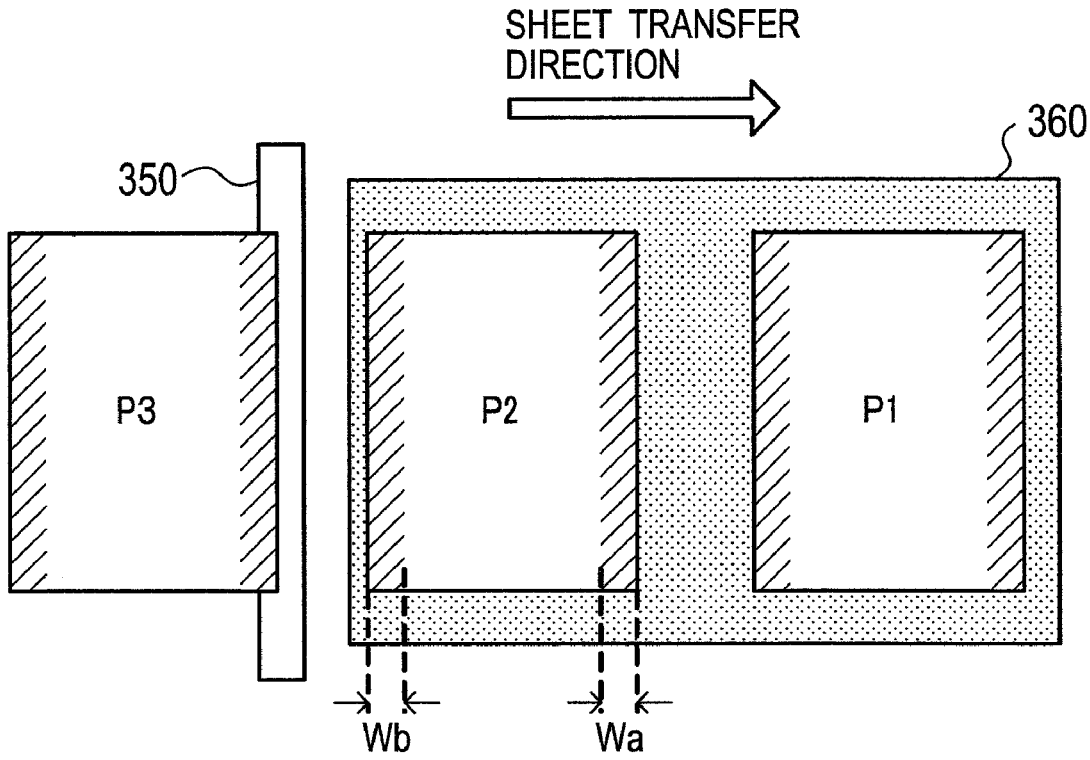
FIG. 6 is a plan of print sheets arranged for transfer by a transfer belt.

Discussed below is the reason why the print job to be executed at a low ink temperature is a print job having reduced amounts of print in regions at both ends in a transfer direction of print sheets. It is now supposed that, as illustrated in FIG. 6, there are print sheets P1, P2, and P3 in way of transfer using the transfer belt 360. The print sheets are to be printed in the order of P1, P2, and P3. Shown in the figure is a situation with the print sheet P3 put in a pause at the register rollers 350, waiting for a timing to establish an adequate sheet interval to have the print sheet P3 travel in a transfer direction of the transfer belt 360.

Figure 7:
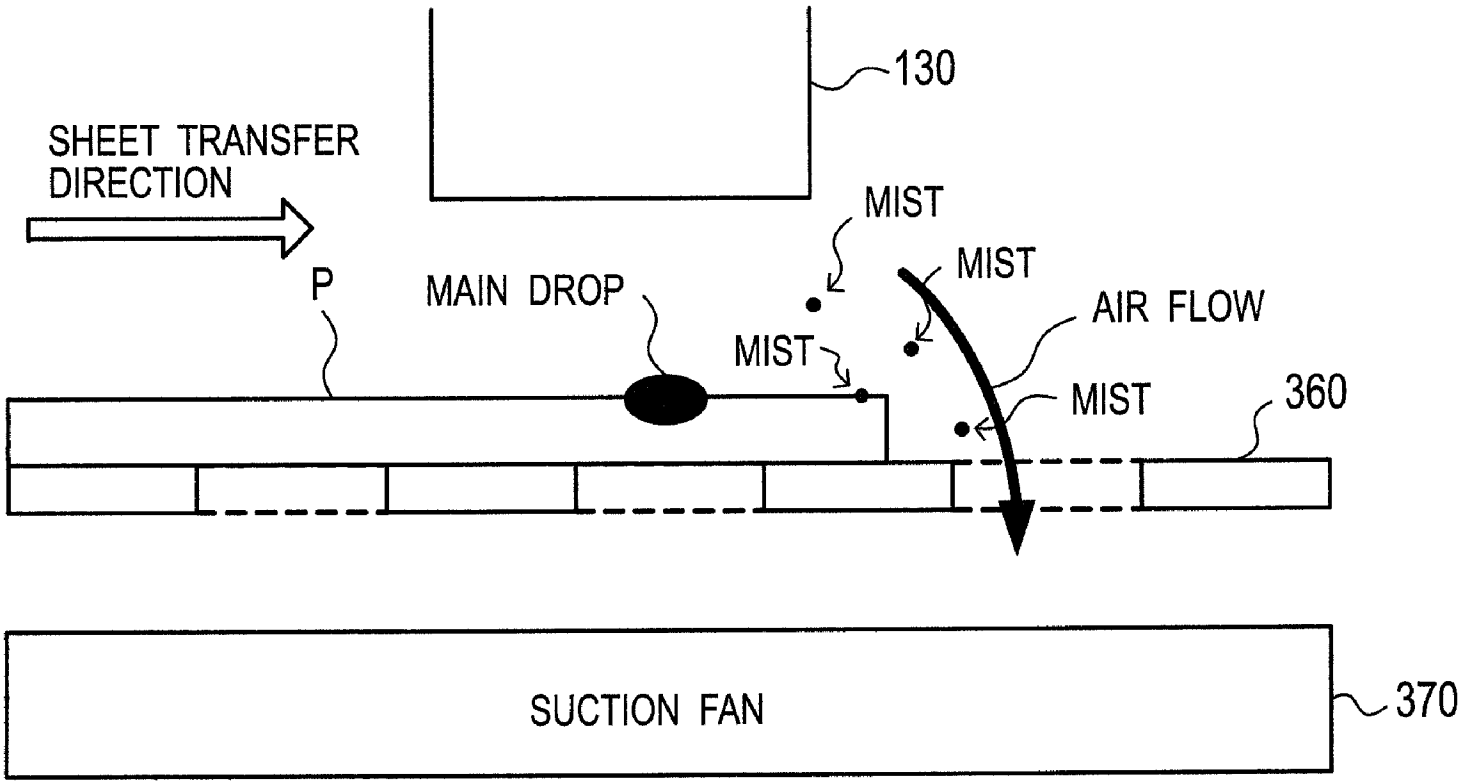
FIG. 7 is a section of the transfer belt with a suction fan causing air to flow.

The transfer belt 360 has a transfer-oriented face thereof formed with a multiplicity of through holes for air communication, affording for suction forces of air streams produced by the suction fan 370 to such print sheets onto the transfer belt 360. As illustrated in FIG. 7, such air streams are guided in regions outside print sheets, to describe streamlines extending from around the inkjet head 130 through air communication holes toward the suctions fan 370. Therefore, around a periphery of print sheet, there appear streams of air flowing outside edges of print sheet.

Mist is produced at the inkjet head 130, and rides on air streams, flying about associated edges of print sheet, resulting in significant affects of mist at those edges of print sheet. With an increase in transfer speed of print sheet, there appear streams of air flowing along the transfer direction of print sheet, as well. In due course, there are significant affects of mist observed in regions at both ends in the transfer direction of each print sheet, as shown by hatchings in FIG. 6.

Therefore, if the print sheets are to be printed with reduced print ratios at both ends thereof in the transfer direction, there will be reduced amounts of mist produced around peripheries of the print sheets, resulting in reduced amounts of mist guided to both ends in the transfer direction of the print sheets, as well. This is the reason why affects of mist can be reduced.

Figure 8A:
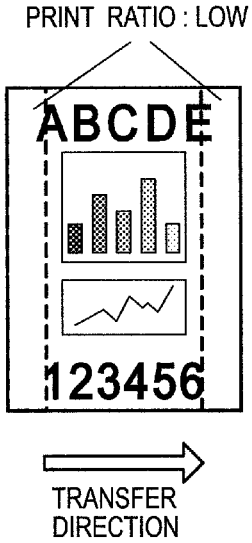
FIGS. 8A, 8B, 8C, and 8D are combinations of explanatory diagrams of print ratios at transfer-longitudinal ends.
Figure 8B:
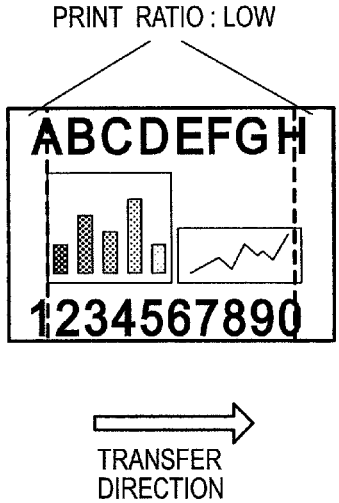
Figure 8C:
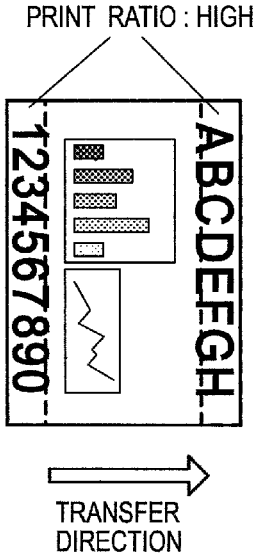
Figure 8D:
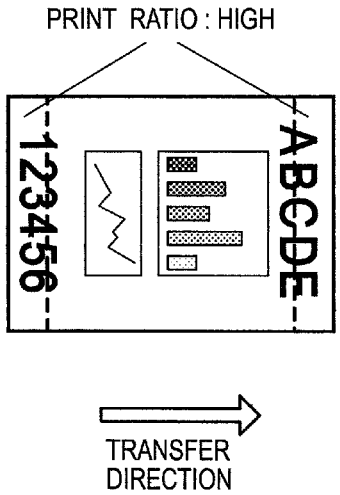

More specifically, as illustrated in FIG. 8A, in transfer of a print sheet oriented in a transfer-transverse direction, it becomes harder for the print sheet to receive affects of mist as the print ratio is decreased in regions at both ends of the longer side, and as illustrated in FIG. 8B, in transfer of a print sheet oriented in a transfer-longitudinal direction, it becomes harder for the print sheet to receive affects of mist as the print ratio is decreased in regions at both ends of the shorter side. To the contrary, as illustrated in FIG. 8C, in transfer of a print sheet oriented in a transfer-transverse direction, it becomes easier for the print sheet to receive affects of mist as the print ratio is increased in regions at both ends of the longer side, and as illustrated in FIG. 8D, in transfer of a print sheet oriented in a transfer-longitudinal direction, it becomes easier for the print sheet to receive affects of mist as the print ratio is increased in regions at both ends of the shorter side.

It is noted that for reference values of print ratio and widths Wa and Wb (cf. FIG. 6) of regions at both transfer-longitudinal ends that each constitutes a target of calculation of print ratio, there may be use of experiments or the like to determine in advance such values that render affects of mist insignificant. It also is noted that the target of calculation of print ratio is not limited to a rectangular shape.

Referring again to the flowchart in FIG. 4, at the step S106, where it is determined alter calculation of a print ratio in regions at both ends in a transfer direction of print sheet whether or not the print ratio is equal to or smaller than a prescribed reference value, if the print ratio in regions at both transfer-longitudinal ends of print sheet falls within a range of values larger than the reference value (No at the step S106), the control flow goes to a step S108 to determine, after an additional calculation of a print ratio in regions at both ends in a perpendicular direction to the transfer direction of print sheet, whether or not the print ratio is equal to or smaller than a prescribed reference value. If the print ratio in regions at both transfer-transverse ends of print sheet falls within a range of values larger than this reference value (No at the step S108), it would be difficult to prevent affects of mist, and the control flow again goes to the step S101, to wait for a measure of ink temperature equal to or higher than the first reference temperature, without starting print.

At the step S108, if the print ratio in regions at both transfer-transverse ends of print sheet falls within a range of values equal to or smaller than the reference value (Yes at the step S108), the control flow goes to a step S109 to determine whether any feeder is available or not for a feed of a sheet oriented in a direction rotated at 90 degrees from an orientation of sheet designated in the print setting. If no feeder is available for the feed of a sheet oriented in a direction rotated at 90 degrees from the orientation of sheet designated in the print setting (No at the step S109), it would be difficult to prevent affects of mist, and the control flow again goes to the step S101, to wait for a measure of ink temperature equal to or higher than the first reference temperature, without starting print.

On the other hand, at the step S109, if any feeder is available for the feed of a sheet oriented in a direction rotated at 90 degrees from the orientation of sheet designated in the print setting (Yes at the step S109), the control flow goes to a step S110 to have the sheet transfer controller 240 set for a feed of sheet using that feeder, i.e., a certain feeder that is adapted for the feed of a sheet oriented in a direction different from the orientation of sheet designated in the print setting.

Then, the control flow goes to a step S111 to have the dot data rotater 222 rotate a set of dot data stored in the dot data memory 221 at 90 degrees to re-store in the dot data memory 221. Then, the control flow goes to a step S112 to execute a printing process in accordance with the set of dot data restored in the dot data memory 221. In this situation, for adequate ink discharge quantities to be secured, each driver 132 is adapted to supply an associated set of piezoelectric elements 136 with a set of drive signals with higher voltages than the normal process. That is, those drive signals have increased voltages for execution of a printing to print relatively small numbers of dots in regions at transfer-longitudinal ends of a print sheet or print sheets.

Figure 9A:
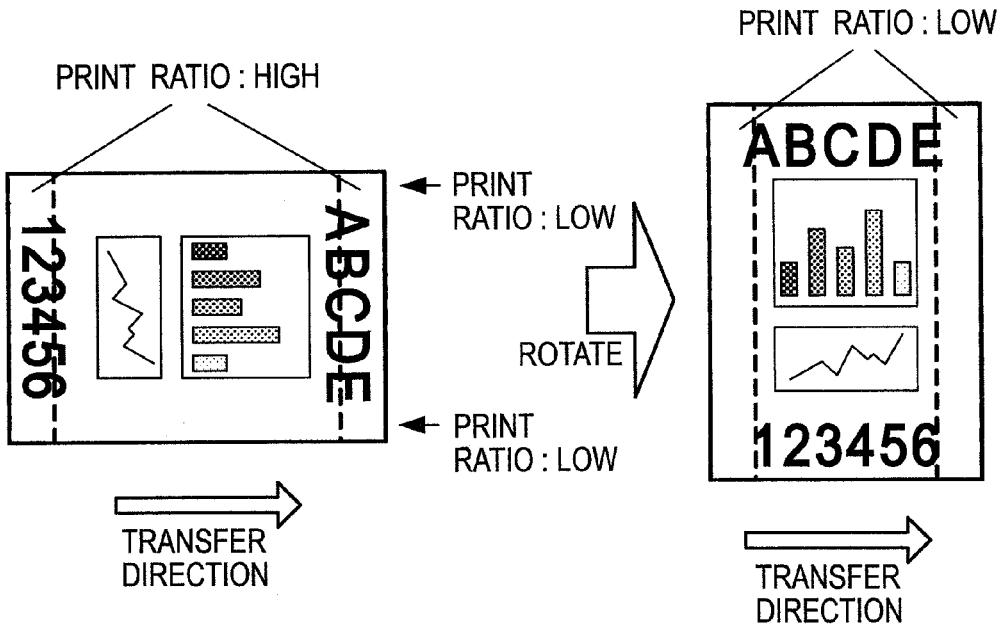
FIGS. 9A and 9B are combinations of explanatory diagrams of relationships between dot data rotation and sheet direction change.
Figure 9B:
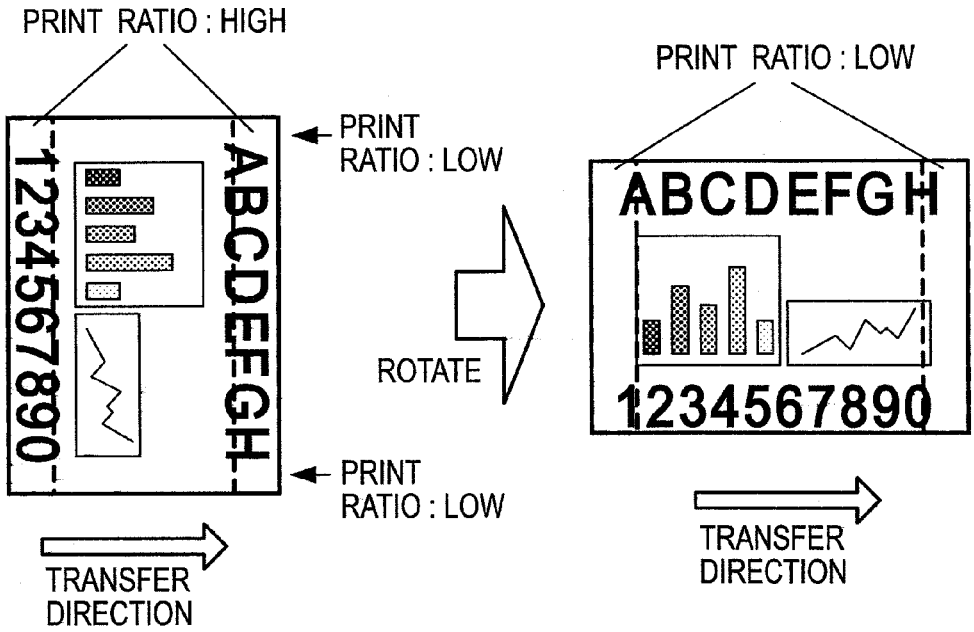

Those control actions are illustrated in FIGS. 9A and 9B. That is, FIG. 9A illustrates a phase of control after a print setting for transfer of a print sheet oriented in a transfer-longitudinal direction, wherein for a printing with combination a high print ratio in regions at both ends of a shorter side and a low print ratio in regions at both ends of a longer side, there are steps implemented to rotate a set of dot data at 90 degrees, and change the orientation of print sheet or print sheets to be fed. This affords to render regions of low print ratios at transfer-longitudinal ends of print sheet, making it hard to receive affects of mist. On the other hand, FIG. 9B illustrates a phase of control after a print setting for transfer of a print sheet oriented in a transfer-transverse direction, wherein for a printing with combination a high print ratio in regions at both ends of a longer side and a low print ratio in regions at both ends of a shorter side, there are steps implemented to rotate a set of dot data at 90 degrees, and change the orientation of print sheet or print sheets to be fed. This affords to render regions of low print ratios at transfer-longitudinal ends of print sheet, making it hard to receive affects of mist.

Figure 10:
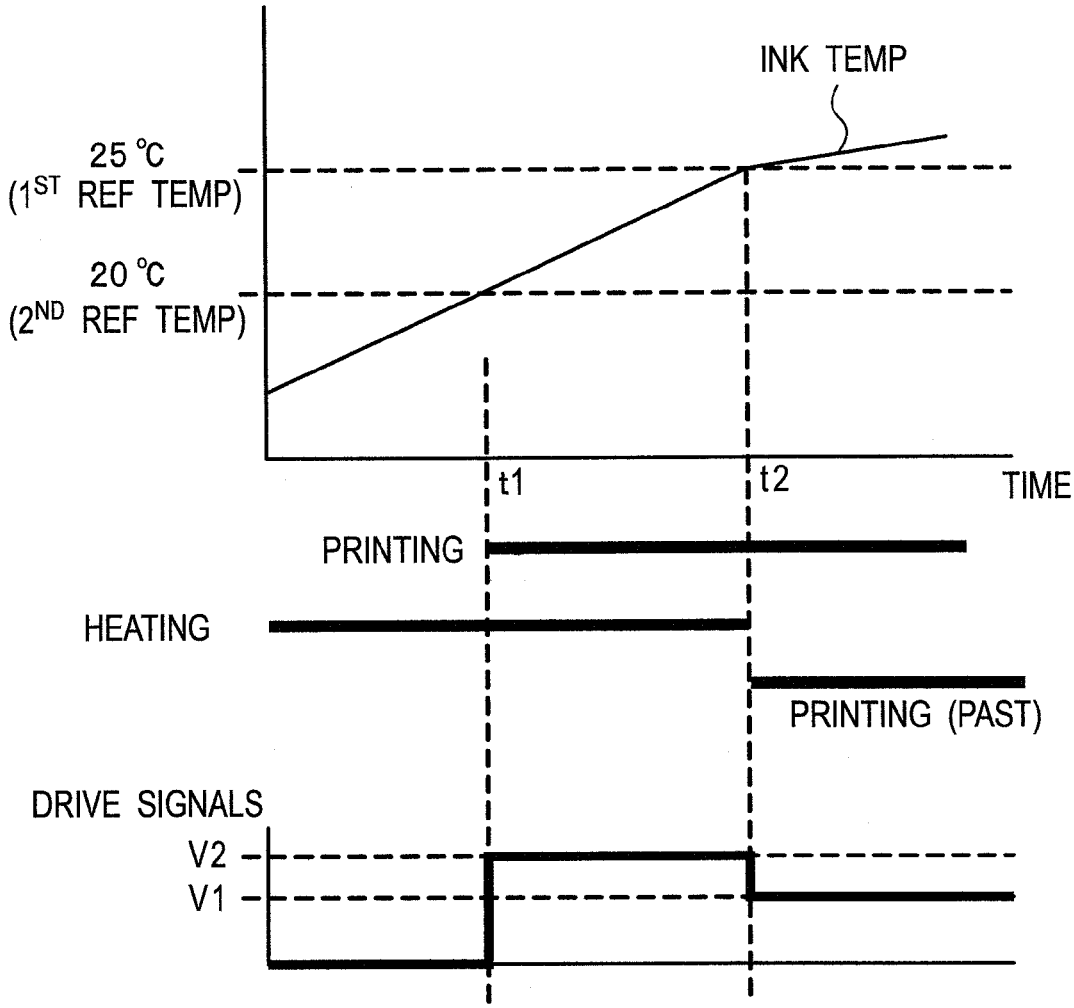
FIG. 10 is an explanatory diagram of relationships between ink temperature and print start time.

With control actions for print described, according to this embodiment, it is enabled as shown in FIG. 10 for a print job with low print ratios at transfer-longitudinal ends of print sheets, to operate a heater for heating ink under a condition with a measure of ink temperature lower than the second reference temperature, and start a printing at a time t1 when the ink temperature becomes equal to the second reference temperature. In the past, there were significant affects of increased mist production due to drive signal voltages changed from a normal V1 to a greater V2, so it was unable to start a printing till a time t2 when ink temperature got equal to a second reference temperature. However, in this embodiment, there is a print job executed with low print ratios at transfer-longitudinal ends of print sheets, thereby affording a reduced affect of increase in mist production rate. This embodiment thus allows for a printing start time to be set earlier at low temperatures with controlled affects of mist production.

In the example described, there is a set of dot data rotated to thereby rotate an orientation of a frame of image data to be printed, while there may be an orientation of a frame of image data rotated by changing orders of reading dot data from the dot data memory 221. Further, there is a combination of an orientation of dot data and an orientation of print sheets adjusted make a print ratio of both end regions smaller than a reference value, while there may be a comparison made between a print ratio in regions at both ends of a direction of a longer side and a print ratio in regions at both ends of a direction of a shorter side followed by adjustment of a combination of an orientation of dot data and an orientation of print sheets to render the both end regions of the lower print ratio oriented in a transfer direction.

Figure 11:
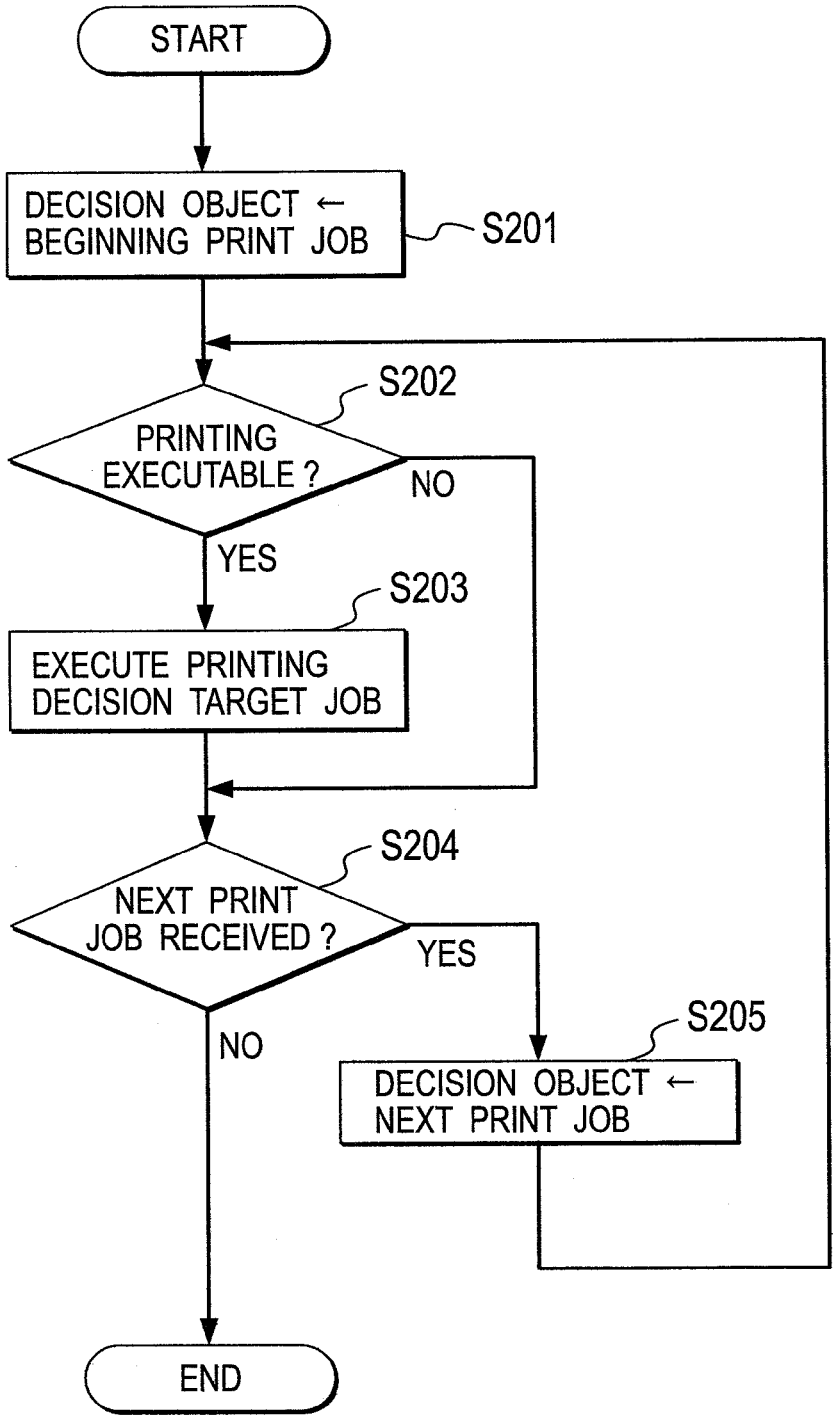
FIG. 11 is a flowchart of control actions in a processing for print jobs received at the inkjet printer of FIG. 1.

Description is now made of a processing upon reception of print jobs at an inkjet printer 100 according to a modification of the embodiment, with reference being made to a flowchart of FIG. 11. Typically, print jobs are processed in orders of reception so, if a first received print job fails to meet a criterion to execute a printing at low ink temperatures, there is no chance for execution of print of any one of subsequent print jobs to start before the ink temperature comes up to the first reference temperature, even if these print jobs include a print job or print jobs of which a print is executable. To this point, the modification of embodiment is configured to implement the following processes.

First, at a step S201, there comes the print job controller 210 to deal with a first received beginning print job as a target of determination. Then, at a step S202, the above-noted criterion is based on to determine whether or not the print job as a target of determination is executable. That is, it is determined if the print ratio in regions at both ends in the transfer direction is settable to be equal to or lower than a reference value.

As a result, if the print job as a target of determination is executable (Yes at the step S202), then the control flow goes to a step S203 to execute the print job. On the other hand, if it is not executable (No at the step S202), the print job is not executed.

Then, the control flow goes to a step S204 to determine whether or not any subsequent print job is accepted. If any subsequent print job is accepted (Yes at the step S204), then the control flow goes to a step S205 to set the subsequent job as a target of determination, and again goes to the step S202 to determine whether or not this print job is executable. If this print job is executable (Yes at the step S202), the control flow goes to the step S203 to execute the print job as a target of determination.

The foregoing steps are thus repeated, so any executable print job is executed even if the order of acceptance is late, with a priority to non-executable print jobs. Such control actions permit print waiting times of print jobs to be wholly reduced. For instance, even if the first accepted print job fails to meet the criterion for execution of print at low ink temperatures, it is enabled to start execution of print of executable print jobs if any among subsequent print jobs at ink temperatures failing to meet the first reference temperature, but equal to or higher than the second reference temperature.

While the preferred embodiments of the present invention have been described using specified terms, such description is for illustrative purposes, and it is to be understood that changes and variations may be made without departing from the spirit or scope of the following claims.

This application is based upon the Japanese Patent Application No. 2009-139005, filed on Jun. 10, 2009, and the entire content of which is incorporated by reference herein.

What is claimed is:

1. An image former comprising:

an ink route configured for circulation of ink;

a sheet transfer system configured for transfer of sheets;

an inkjet head configured to use ink received from the ink route to form images on a sheet in the sheet transfer system;

a temperature measuring element configured to measure a temperature of ink received from the ink route; and a controller configured for control of temperatures of ink in the ink route and control of actions of the sheet transfer system and the inkjet head, the controller being adapted to work with a measure of temperature of ink at the temperature measuring element within a first temperature range, to implement a first control process of having the inkjet head propel out droplets of ink at a first discharge speed for formation of images; and with a measure of temperature of ink at the temperature measuring element within a second temperature range lower than the first temperature range, to implement a second control process of having the inkjet head propel out droplets of ink at a second discharge speed greater than the first discharge speed for formation of images, wherein the controller is adapted to determine that end regions of a frame of images to be formed in regions at transfer-longitudinal ends of a sheet to be transferred in the sheet transfer system have a print ratio within a prescribed range, to execute formation of images.

2. The image former according to claim 1, wherein the sheet transfer system includes:

a first feeder configured to feed a sheet with a shorter side crossing a transfer direction thereof; and a second feeder configured to feed a sheet with a longer side crossing a transfer direction thereof, and the controller is adapted for use of a combination of:

having the sheet transfer system select one of the first feeder and the second feeder; and selecting one of a rotation and non-rotation of the frame of images to be formed by the inkjet head, to determine that the print ratio resides within the prescribed range, to implement the second control process.

3. The image former according to claim 2, wherein the controller is adapted to work after selection of the rotation of the frame of images to be formed by the inkjet head, not to implement the second control process for a disability of having one of the first feeder and the second feeder selected to provide an adequate feeder to set the print ratio within the prescribed range.

4. The image former according to claim 1, wherein the controller is adapted to determine that the print ratio resides within the prescribed range, for a respective print job as a unit.

5. The image former according to claim 4, wherein the controller is adapted to work with a plurality of print jobs received, to implement the second control process with a priority to a print job after a determination that the print ratio resides within the prescribed range.

6. The image former according to claim 1, wherein the ink route comprises a heater configured to heat ink, and the controller is adapted to work with a measure of temperature of ink at the temperature measuring element within the second temperature range, to have the heater heat ink, and with a measure of temperature of heated ink at the temperature measuring element within the first temperature range, to have the heater stop heating ink.

7. The image former according to claim 1, further comprising an input interface configured to inform the controller of an interfaced user's instruction, and adapted to work with a measure of temperature of ink at the temperature measuring element within the second temperature range, to be inputted thereon a command to instruct the controller not to implement the second control process.

* * * * *